US005587544A

United States Patent [19]

Fujii et al.

[11] Patent Number: 5,587,544

[45] Date of Patent: Dec. 24, 1996

[54] DRUM

[75] Inventors: Junji Fujii; Yukimasa Okumura, both of Hamamatsu, Japan

[73] Assignee: Yamaha Corporation, Shizuoka, Japan

[21] Appl. No.: 443,581

[22] Filed: May 17, 1995

[30] Foreign Application Priority Data

Jun. 22, 1994 [JP] Japan ..... 6-139999
Aug. 12, 1994 [JP] Japan ..... 6-190427

[51] Int. Cl.[6] ..... G10D 13/02

[52] U.S. Cl. ..... 84/411 R; 84/413

[58] Field of Search ..... 84/411 R, 413, 84/412, 411 A, 419

[56] References Cited

U.S. PATENT DOCUMENTS 4,928,565 5/1990 Hsieh ..... 84/411 R
5,410,938 5/1995 Kurosaki et al. ..... 84/411 R

FOREIGN PATENT DOCUMENTS 57-34551 7/1982 Japan .

*Primary Examiner*—Patrick J. Stanzione
*Attorney, Agent, or Firm*—Koda and Androlia

[57] ABSTRACT

A drum producing a wooden tom-tom sound free of any disharmony including reinforcement rings made of wood, plastic, etc. and fastened to both ends of the shell and batter heads stretched over these reinforcement rings with no parts for holding the batter heads projecting beyond the batter heads level, thus making a conventional rim shot impossible but a stick-playing method or edge shot in which the batter head and the reinforcement ring are simultaneously struck with a stick possible.

7 Claims, 5 Drawing Sheets

DRUM

BACKGROUND OF THE INVENTION

1. Field of the Invention

The present invention relates to a drum which is suitable for use as a bass drum, snare drum, tom-tom, marching drum, etc.

2. Prior Art

FIG. 7 shows one example of drums such as bass drums, snare drums, tom-toms and marching drums, etc. The drum includes a trunk-form main body or shell 1 and batter heads 2*a* and 2*b* that are stretched at an even tension by head supporting and stretching assemblies 3 over the two (top and bottom in the figure) openings of the shell 1. The shell 1 is usually made of wood, FRP, metal, etc. and is formed in a cylindrical shape, and the batter heads 2*a* and 2*b* are made of a natural skin or a plastic film, for example, a polyester resin, polycarbonate resin, etc.

Generally, a drum sound is generated by causing the air column sealed between the two batter heads to act as a vibration-transmitting medium. For example, when the batter head on a first side is struck with a stick, the air column transmits the resulting vibration to the batter head on a second side, thus causing the batter head on the second side to vibrate. The air column then transmits back this vibration to the batter head on the first side. These repeated vibrations are generated in both batter heads.

Accordingly, it is required that the shell maintains a stable shape and is not deformed by weather conditions, tension applied to the batter heads, etc. so that the tone remains relatively stable. In addition, the shell must not show any self-vibration, self-absorption, etc.

The head supporting and stretching assembly is generally comprised of an annular head frame, an annular tightening frame (rim), lugs and tightening bolts. More specifically, in FIG. 7, the head frame 5 is secured to the outer circumferential surface of the shell 1 so as to hold therein a part of the batter head. The annular tightening frame (rim) 6 includes a cylindrical portion 6a and a flange portion 6*b* and is mounted on the head frame 5 so as to be spacedly located on the outer circumference of the shell 1. The lugs 7 are provided on the outer surface of the shell 1 via fasteners 16, and the tightening bolts 8 connect the rim 6 to the lugs 7.

As seen from FIG. 7, the top edge 6*a'* of the cylindrical portion 6*a* of the upper rim 6 is located at a higher level than the top edge 1' of the shell 1, and the bottom edge 6*a"* of the cylindrical portion 6*a* of the lower rim 6 is located at a lower level than the lower edge 1" of the shell 1.

When the rims 6 are moved in the axial direction of the shell 1 by rotating the tightening bolts 8, the pressing force exerted on the head frames 5 by the rims 6 is changed. The tension of the batter heads, i.e., the tone quality of the drum, can be thus adjusted.

One example of this type of drum is disclosed in the Japanese Utility Model Publication (Kokoku) No. 57-34551.

In use, three ways of playing drums with sticks are known, which are:

(1) Striking the head surface with the tip end of the stick.

(2) Striking the head surface with the tip end of the stick and at the same time striking the rim with the middle portion of the stick. This method increases the vibrational energy of the rim, causing the energy to be efficiently emitted from the head surface via the stick as well.

(3) Striking the rim with the grip end of the stick while pressing the tip end of the stick against the head surface. This striking method generates a relatively quiet tone quality with good sharpness.

Of the three methods described above, the methods (2) and (3) are known as "rim shots". Since the rims are ordinarily made of metal, the rim shot method (3) produces a higher and more metallic tone than the rim shot method (2).

When playing with the rim shot methods, there is no problem with snare drums, which are designed to produce a high, metallic tone. However, for the so-called tom-toms, which are for producing a plain, wooden tone, rim shots are not very effective. Accordingly, rim shots are not very widely used with tom-toms except in Latin music, and the musical expression of such drums is limited.

In addition, there is a further problem. Since the top ridges of the rims project beyond the batter heads for facilitating the rim shots, the emission of sound from the batter heads tends to be poor.

SUMMARY OF THE INVENTION

Accordingly, the object of the present invention is to provide a drum characterized in that the tip end or the upper edge of the rim is located below the head surface level. As a result, according to the present invention, a wooden tom-tom type sound can be generated without any disharmony that is generated when the edge part of the shell of the drum is struck, so that the playing range of the drum is widened, and the sound from the batter head is good and accomplished naturally.

It is another object of the present invention to provide a drum wherein the impact of the stick when the edge of the shell is struck is moderated, so that a good striking "feeling" can be obtained.

In the following description of the invention, the stick playing method in which the head surface and the edge part of the shell of a drum are simultaneously struck will be referred to as "edge shot", thus distinguishing this from a conventional rim shot.

In order to accomplish the object, the drum of the present invention, in which the batter heads are stretched over the openings of a shell by means of head supporting and stretching assemblies, includes reinforcement rings which are mounted to the open ends of the shell so that batter heads are stretched over these reinforcement rings; and rims of the head supporting and stretching assemblies are positioned closer to the shell than to the surfaces of the batter heads.

Furthermore, the drum of the present invention includes a multiple number of spacers which are interposed between the shell and reinforcement rings, so that predetermined-size spacings are kept between the shell and reinforcement rings.

In addition, the spacers are positioned so as to correspond to tightening bolts which connect lugs to the rims of the head supporting and stretching assemblies.

The reinforcement rings used in the drum of the present invention may be formed from wood, plastic, fiber-reinforced plastic, etc., and the spacers may be formed as integral elements to the reinforcement rings.

In the present invention, the reinforcement rings on which the batter heads are stretched are installed so as to project beyond the rims and are positioned beyond the upper and lower edges of the rims. Thus, the edge shots can be played and also the shell is reinforced. Furthermore, since the reinforcement rings are made of wood, plastic, fiber-reinforced plastic, etc., a tom-tom type sound is generated.

The spacers provide a space between the shell and the reinforcement rings. As a result, the reinforcement rings are more easily flexed, and the impact of the stick during the edge shots can be moderated.

DETAILED DESCRIPTION OF THE INVENTION

The present invention will be described in detail in terms of embodiments illustrated in the accompanying drawings.

Figure 1:
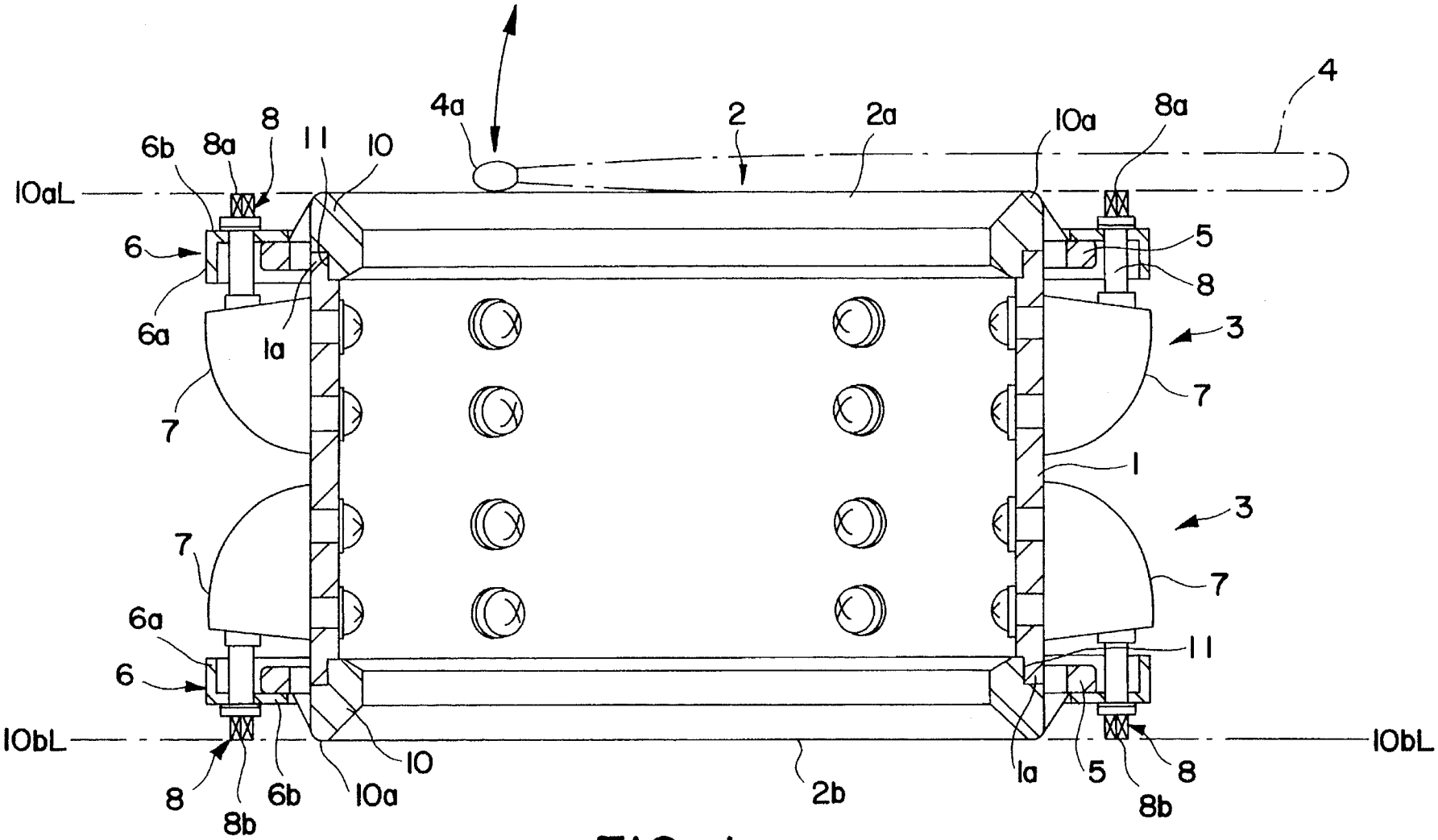
FIG. 1 is a sectional view of one embodiment of the drum according to the present invention.
Figure 7:
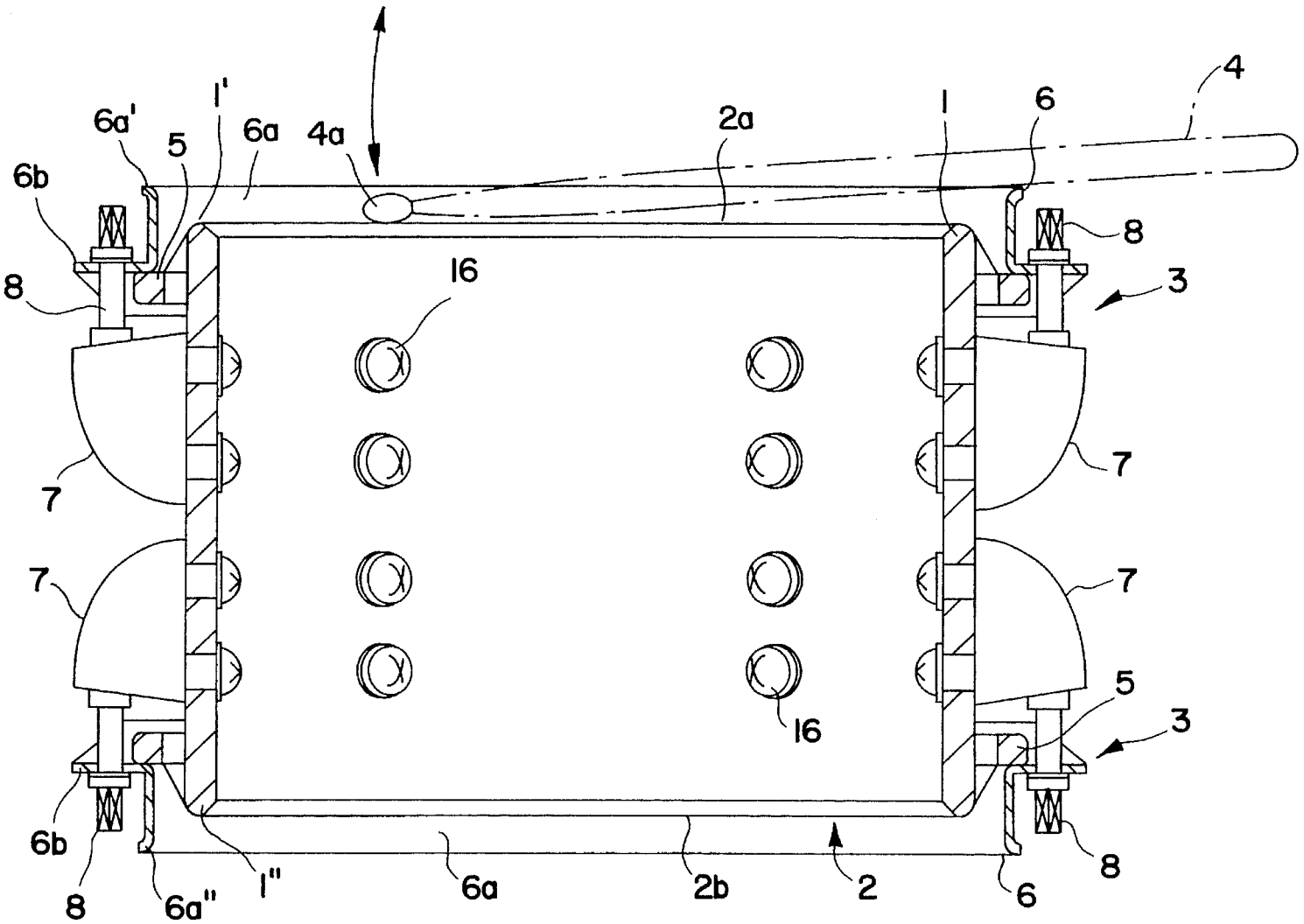
FIG. 7 PRIOR ART
FIG. 7 is a sectional view of a conventional drum.

FIG. 1 illustrates an embodiment in which the present invention is applied to a tom-tom. Elements which are the same as those in FIG. 7 are labeled with the same symbols, and a detailed description of such is omitted.

In the embodiment shown in FIG. 1, two (2) reinforcement rings 10 are fastened to both (upper and lower in FIG. 1) open ends of the shell 1 of the drum. The top and bottom batter heads 2 are stretched over these reinforcement rings 10.

Each one of the rims 6 of the head supporting and stretching assemblies 3 is L-shaped in cross section and has no portion that projects beyond the batter heads 2 in an axial direction of the shell 1 including the reinforcement rings 10, so that rim shots cannot be performed. More specifically, each one of the rims 6 which are installed on the head frames 5 has a cylindrical portion **6*a* and flat portion 6*b*. The cylindrical portion 6*a* of the rim 6 provided near the upper end of the shell 1 is oriented toward the bottom of the shell 1 (or oriented downward in FIG. 1); and the cylindrical portion 6*a* of the rim 6 provided near the lower end of the shell 1 is oriented toward the top of the shell 1 (or oriented upward in FIG. 1). In addition, the upper bolts 8 are provided so that the upper ends 8*a* of the upper bolts 8 are equal to or below, in FIG. 1, the upper edge level 10*a*L of the upper reinforcement ring 10; and the lower bolts 8 are provided so that the lower ends 8*b* of the lower bolts 8 are equal to or higher, in FIG. 1, the lower edge level 10*b*L of the lower reinforcement ring 10*a***.

Thus, the head supporting and stretching assemblies 3 that includes the rims 6 and bolts 8 have no portion that is beyond the upper and lower edge levels of the reinforcement rings 10 provided on the upper and bottom open ends of the shell 1. In other words, the rims 6 and bolts 8 of the head supporting and stretching assemblies 3 are positioned so that they are between imaginary planes defined by the upper and lower levels **10*a*L and 10*b*L of the two (upper and lower) reinforcement rings 10. As a result, edge shots in which head-supporting portion 10A of the reinforcement ring 10** is struck can be made.

The reinforcement rings 10 are made of wood, plastic, fiber-reinforced plastic (FRP), etc. and have a larger circumferential thickness than the shell 1. Furthermore, the head-supporting portions 10A of the reinforcement rings 10 are formed with a reversed V-shaped cross section in order to clarify the supporting points of the batter heads 2.

In addition, an annular groove 11 which receives a thinner part la on each open end of the shell 1 is formed on the outer circumferential surface of each reinforcement ring 10. In other words, the annular groove 11 is formed on the opposite side from the head-supporting portion **10*a* of the reinforcement ring 10**.

If the reinforcement rings 10 are made of wood, various types of wooden materials may be used without any particular restrictions on the type of wood used. However, in order to reinforce the shell 1, it is desirable to use a hard deciduous wood rather than a soft coniferous wood.

The reinforcement rings are of the detachable type relative to the shell 1. They can be replaced by loosening the tightening bolts 8 and removing the batter heads 2.

In a drum structured as described above, the conventional rim shot stick play is not possible, but an edge shot can be performed. In other words, a stick play, in which the reinforcement ring 10 is struck with a middle portion of the stick at the same time that the approximate center portion of the batter head 2 is struck with the tip end **4*a* of the stick 4, can be performed. In this case, the edge shot is a stick playing method which is similar to a conventional rim shot. However, since the reinforcement ring 10** that is struck is made of wood, plastic or fiber-reinforced plastic, a plainer, more wooden sound (unlike the high metallic tone produced by a conventional rim shot) can be generated. Accordingly, this playing technique can be used in music other than Latin music as well, so that the playing range of the drum as a musical instrument can be broadened.

In conventional drums, the rims 6 (particularly the edges of the cylindrical portions of the rims) project beyond the batter head surface level, while in the present invention, nothing projects beyond such head level. Accordingly, sound can be naturally emitted from the head surfaces.

In the embodiment described above, the reinforcement rings 10 are provided at the openings which are at both ends (upper and bottom ends in FIG. 1) of the shell 1. However, the present invention is not limited to this arrangement. It is also possible to use one reinforcement ring 10 at only one open end (or the top end) of the shell 1. In this case, the batter head 2 is stretched directly over the opening of the shell 1 on the other end that has no reinforcement ring, and a part of the rim projects beyond the head surface level as in the conventional drum shown in FIG. 7. Thus, with this structure, both the rim shot and the edge shot could be performed by selecting one of the two different batter head surfaces.

Figure 2:
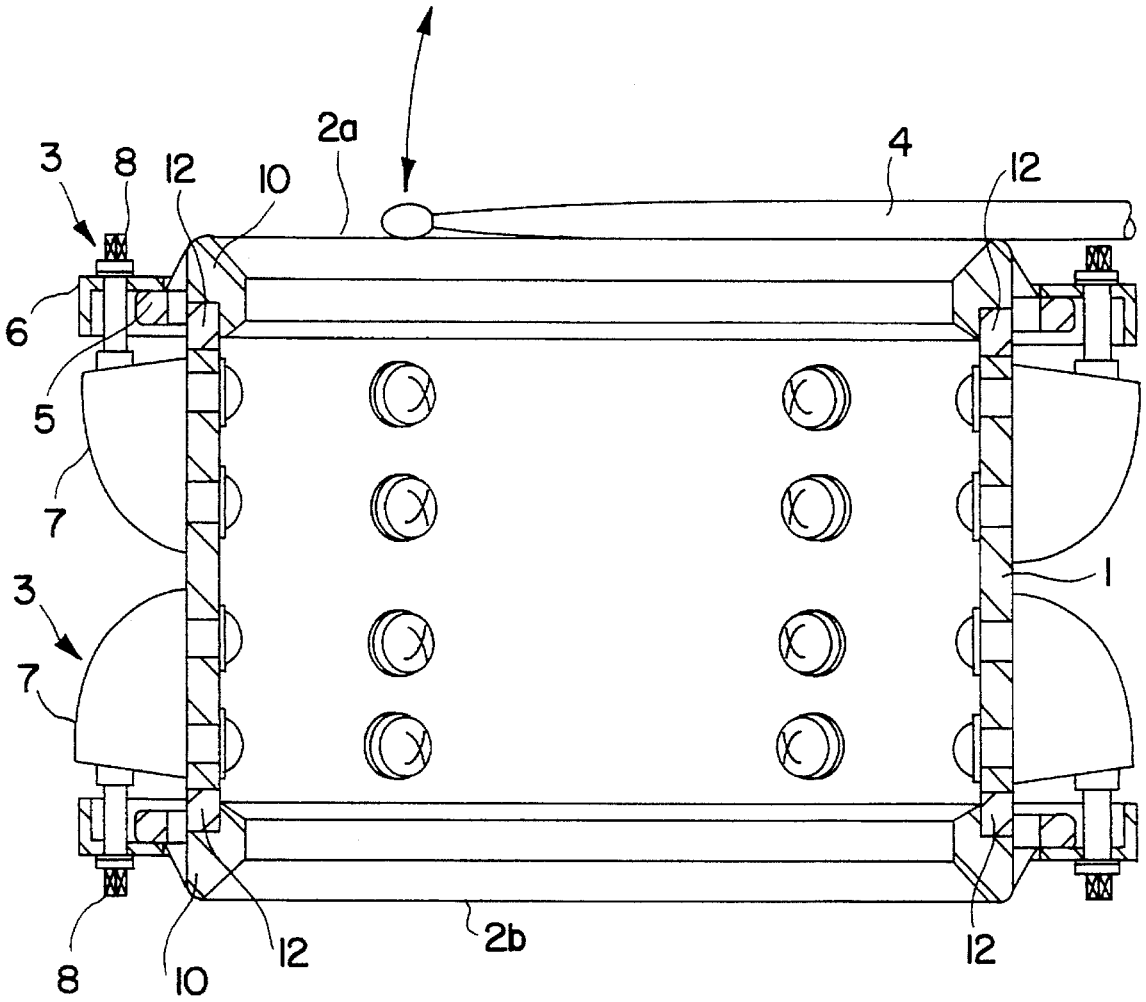
FIG. 2 is a sectional view of another embodiment of the drum according to the present invention.
Figure 3:
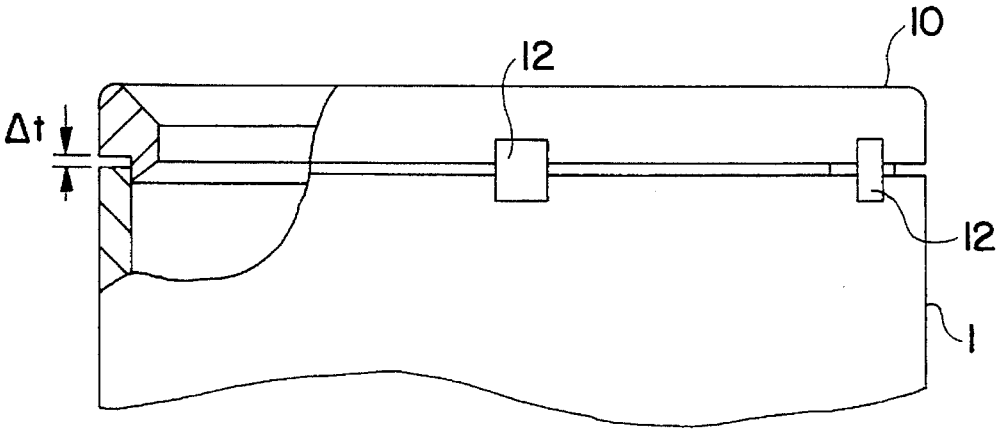
FIG. 3 is a partially cut-away front view of essential portions of the drum shown in FIG. 2.
Figure 4:
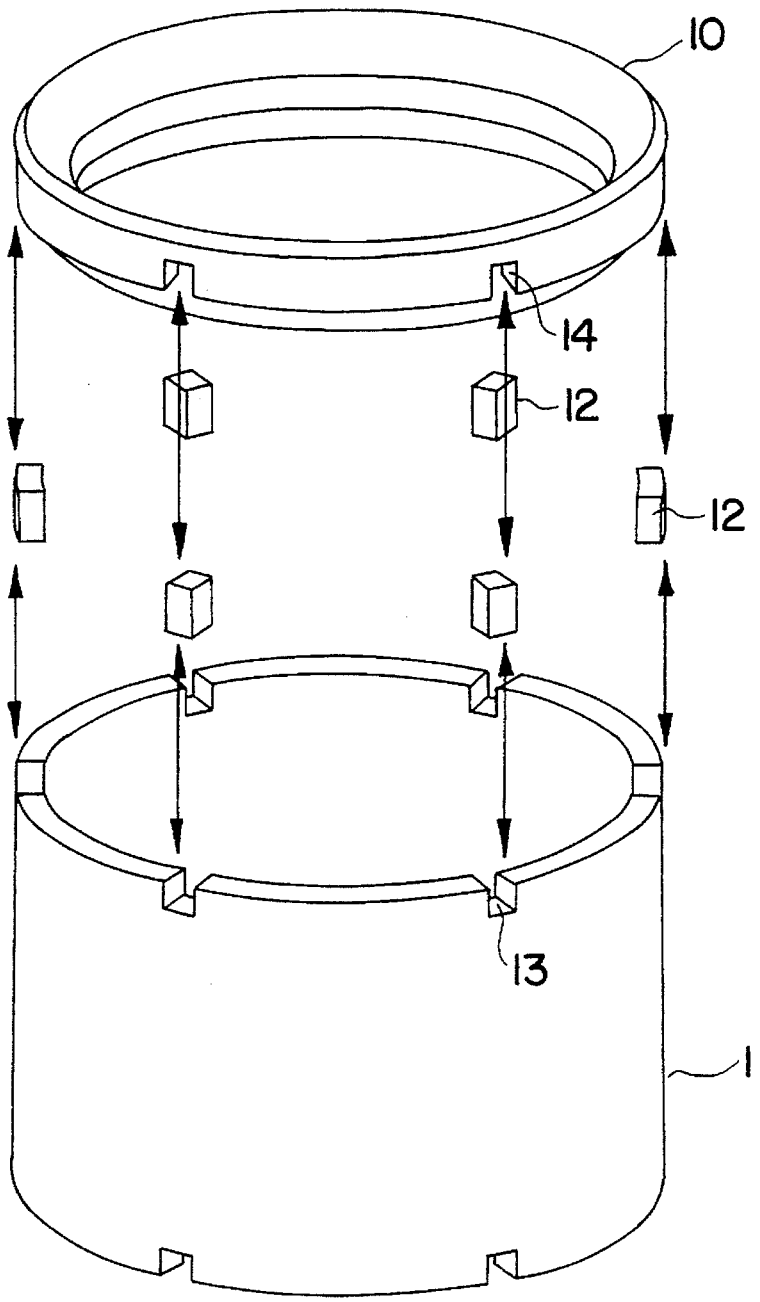
FIG. 4 is an exploded perspective view showing the shell, one of the reinforcement rings and the spacers used in the drums of the present invention.

FIG. 2 shows a drum of another embodiment of the present invention, FIG. 3 shows one end portion (upper end in the Figure) of the drum with its inside shown partially, and FIG. 4 is an exploded perspective view of the shell and one reinforcement ring.

In the previous embodiment shown in FIG. 1, the length in the axial direction of the shell 1 that includes the reinforcement rings 10 tends to be considerable. Accordingly, there is a danger that the rigidity will be far higher than in a drum that uses ordinary metal rims. As a result, the drum is felt hard when the drum is stricken.

The embodiment in FIG. 2 eliminates such a hard feeling. In the second embodiment, the drum includes a multiple number of spacers 12. The spacers 12 are interposed between each open end of the shell 1 and the corresponding reinforcement ring 10 in a manner that the spacers are equally spaced from each other in the circumferential direction. As a result, an appropriate gap (delta t), as shown in FIG. 3, is obtained between the shell 1 and the reinforcement ring 10.

Like the reinforcement rings 10, the spacers 12 are made of wood, plastic, fiber-reinforced plastic (FRP), etc. The both ends (upper and lower ends in the figures) of the spacers 12, as best shown in FIG. 4, are inserted into recesses 13 and 14 formed in the edges of the open ends of the shell 1 and in the outer circumferential surfaces of the reinforcement rings 10, respectively. In this embodiment, the spacers 12 are formed as right-angled parallelepiped.

Figure 5:
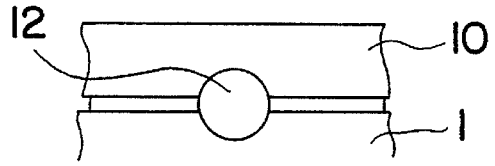
FIG. 5 is a front view showing another type of the spacers used in the drums of the present invention.

The spacer is not limited to this shape. They can be in any other shapes including disk-form (or columnar shape) as shown in FIG. 5.

It is desirable that the spacers 12 be positioned so as to correspond radially to the tightening bolts 8. The reason for this is that if the spacers are installed between the tightening bolts 8, the number of supporting points of the reinforcement rings 10 increases, and it becomes difficult for the reinforcement rings 10 to flex.

In the drum that includes the spacers as described above, there is a gap between the shell 1 and the reinforcement rings 10 by the spacers 12. As a result, the strength of the coupling between the shell 1 and the reinforcement rings 10 could be weaker compared to that in the drum illustrated in FIG. 1. Accordingly, the reinforcement rings 10 that are struck during an edge shot can be caused to flex, thus moderating the impact of the stick during the edge shot, so that a better striking "feeling" is obtained.

In both of the embodiments described above, the invention is described with reference to a tom-tom. However, the present invention is not limited to tom-toms and can of course be embodied in bass drums, snare drums, marching drums, etc.

Figure 6:
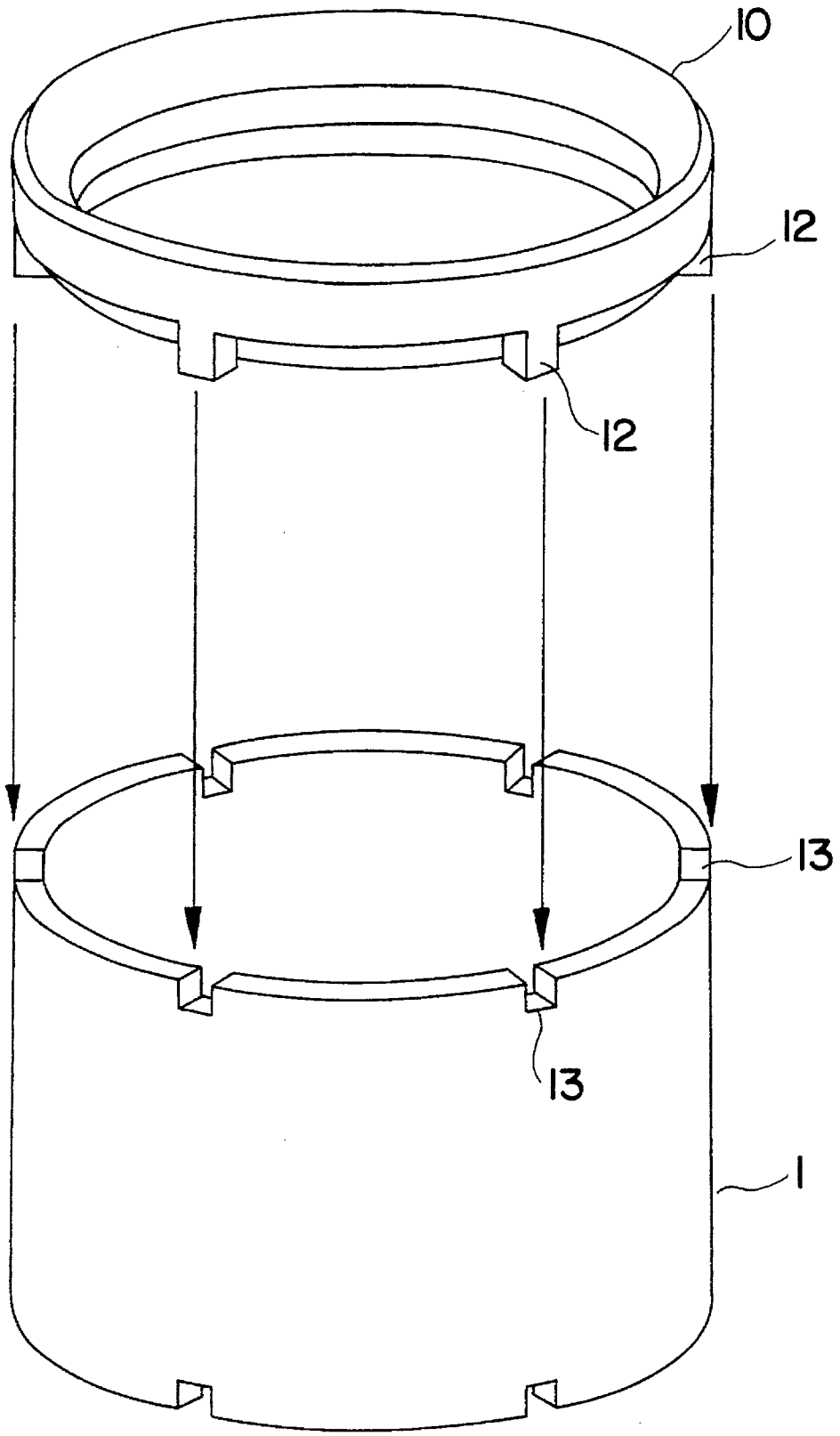
FIG. 6 is a front view showing another type of the spacers combined into the reinforcement rings used in the drums of the present invention.

Moreover, in the embodiment illustrated in FIG. 2, the spacers 12 are formed separately from the reinforcement rings 10. However, as shown in FIG. 6, it is also possible to form the spacers 12 as an integral part of the reinforcement rings 10. In such a case, the number of parts is reduced, and the attachment of the reinforcement rings 10 to the shell 1 would be easier.

As seen from the above, according to the present invention, the reinforcement rings made of wood, plastic, fiber-reinforced plastic, etc. are mounted to the open ends of a shell, and the batter heads are stretched over these reinforcement rings, so that the rims are positioned closer to the shell than it is to the batter heads without having any part sticking out of the batter heads. Accordingly, an edge shot can be performed instead of a conventional rim shot, and because of the material of the reinforcement rings, this edge shot produces a plain, wooden sound.

Thus, when the present invention is applied to a tom-tom, the tom-tom can be used in music other than Latin music too, so that the playing range of the tom-tom as a musical instrument is broadened.

Furthermore, in the present invention, spacers are installed between the shell and the reinforcement rings, forming a gap between the shell and the reinforcement rings. Accordingly, the reinforcement rings can flex easily, so that the impact of the stick during the edge shot can be moderated. As a result, the "feeling" at the time of striking is good, and such a striking feeling is conspicuously improved.

We claim:

1. A drum comprising:

a shell having open ends at both ends;

reinforcement rings provided on edges of said open ends of said shell;

batter heads stretched over outer edges of said reinforcement rings so as to enclose said open ends of said main body; and a plurality of head supporting and stretching assemblies provided on an outer surface of said shell so as to hold said stretched batter heads at both ends of said shell, any part of each one of said supporting and stretching assemblies being between imaginary planes defined by said outer edges of said reinforcement rings.

2. A drum according to claim 1, further comprising spacers provided between said reinforcement rings and said shell.

3. A drum according to claim 2, wherein each one of said spacers is in a right-angled parallelepiped shape.

4. A drum according to claim 2, wherein said spacers are in a columnar shape.

5. A drum according to claim 1, wherein said spacers are integral parts of said reinforcement rings.

6. A drum according to claim 1, wherein said reinforcement rings are made from one selected from the group consisting of wood, plastic and fiber-reinforced plastic.

7. A drum according to claim 1, further comprising spacers provided between reinforcement rings and said shell so as to form gaps between said reinforcement rings and said shell.

* * * * *